US008846597B2

(12) United States Patent
Taylor

(10) Patent No.: US 8,846,597 B2
(45) Date of Patent: Sep. 30, 2014

(54) COTTON-GENTLE HYPOCHLORITE BLEACH

(71) Applicant: LH Taylor Associates Inc., Germantown, MD (US)

(72) Inventor: Lawnie Henderson Taylor, Germantown, MD (US)

(73) Assignee: LH Taylor Associates, Germantown, MD (US)

( * ) Notice: Subject to any disclaimer, the term of this patent is extended or adjusted under 35 U.S.C. 154(b) by 0 days.

(21) Appl. No.: 13/735,368

(22) Filed: Jan. 7, 2013

(65) Prior Publication Data

US 2013/0184193 A1 Jul. 18, 2013

Related U.S. Application Data

(63) Continuation of application No. 13/373,399, filed on Nov. 14, 2011, now Pat. No. 8,349,788, which is a continuation of application No. 11/505,445, filed on Aug. 17, 2006, now abandoned, which is a continuation of application No. 10/612,016, filed on Jul. 3, 2003, now Pat. No. 7,109,157, which is a continuation-in-part of application No. 10/373,787, filed on Feb. 27, 2003, now Pat. No. 6,946,435.

(60) Provisional application No. 60/423,978, filed on Nov. 6, 2002.

(51) Int. Cl.

| | |
|---|---|
| ***C11D 3/395*** | (2006.01) |
| ***C11D 7/06*** | (2006.01) |
| ***D06L 3/08*** | (2006.01) |
| ***D06L 3/06*** | (2006.01) |
| ***C11D 3/39*** | (2006.01) |

(52) U.S. Cl.

CPC ..... *C11D 7/06* (2013.01); *C11D 3/3956* (2013.01); *D06L 3/08* (2013.01); *D06L 3/085* (2013.01); *D06L 3/068* (2013.01); *C11D 3/3947* (2013.01)

USPC ..... 510/380; 510/276; 510/281; 510/286; 510/302; 510/339; 510/367; 510/379

(58) Field of Classification Search

USPC ..... 510/276, 281, 286, 302, 339, 367, 379, 510/380

See application file for complete search history.

(56) References Cited

U.S. PATENT DOCUMENTS

| | | | | |
|---|---|---|---|---|
| 3,929,661 | A * | 12/1975 | Nakagawa et al. | 510/370 |
| 4,622,037 | A * | 11/1986 | Streit et al. | 8/108.1 |
| 4,888,323 | A * | 12/1989 | Matsuda et al. | 512/23 |
| 4,929,383 | A * | 5/1990 | Haendler | 252/187.26 |
| 5,104,571 | A * | 4/1992 | Cramer | 252/187.24 |
| 5,731,276 | A * | 3/1998 | Argo et al. | 510/284 |
| 5,746,936 | A * | 5/1998 | Mercado | 252/187.25 |
| 5,843,190 | A * | 12/1998 | Agostini et al. | 8/108.1 |
| 5,961,879 | A * | 10/1999 | Trigiante | 252/187.25 |
| 6,120,555 | A * | 9/2000 | Scialla et al. | 8/108.1 |
| 6,204,235 | B1 * | 3/2001 | Jimenez Carrillo et al. | 510/379 |
| 6,416,687 | B1 * | 7/2002 | Agostini et al. | 252/186.42 |
| 6,448,215 | B1 * | 9/2002 | Grande et al. | 510/380 |
| 6,534,465 | B1 * | 3/2003 | Briatore et al. | 510/380 |
| 6,894,015 | B1 * | 5/2005 | Briatore et al. | 510/303 |
| 7,288,616 | B2 * | 10/2007 | Tamareselvy et al. | 526/333 |
| 2002/0189633 | A1 * | 12/2002 | Nichole Powers et al. | 134/1 |
| 2003/0032565 | A1 * | 2/2003 | Sivik | 510/101 |
| 2004/0072712 | A1 * | 4/2004 | Man et al. | 510/379 |

* cited by examiner

*Primary Examiner* — Charles Boyer

(74) *Attorney, Agent, or Firm* — Finnegan, Henderson, Farabow, Garret & Dunner, LLP

(57) ABSTRACT

Methodologies and equipment for using a hypochlorite solution to remove menstrual fluid, underarm perspiration or other hard-to-remove stains from soft fabric articles with reduced damage to the fabric articles when compared with popular chlorine bleaches. The soft fabric articles preferably are in white, although the present invention can also be applied to articles in other colors. In one embodiment, the weight concentration ratio of the alkali metal hydroxide over the hypochlorite salt in the hypochlorite solution is no less than 1:12.5. The hypochlorite solution may contain at least 0.2% by weight of sodium hydroxide and/or have a pH of at least 11.8.

10 Claims, No Drawings

COTTON-GENTLE HYPOCHLORITE BLEACH

This application is a continuation of U.S. patent application Ser. No. 10/612,016, filed Jul. 3, 2003, now pending, which, is a continuation-in-part of U.S. patent application Ser. No. 10,373,787, filed Feb. 27, 2003, now U.S. Pat. No. 6,946,435, which claims benefit of U.S. Provisional Application No. 60/423,978, filed Nov. 6, 2002, all of which are incorporated herein by reference in their entireties.

TECHNICAL FIELD

This invention relates to methods and kits useful for removing stains, such as menstrual fluid or underarm perspiration stains, from clothes and other soft fabric articles. This invention also relates to methods for reducing the damaging effect of hypochlorite-containing solution on cotton and other soft fabrics.

BACKGROUND

Menstrual fluid, a composition of blood and endometrial cells, is difficult to remove from cotton panties once it has stained the fabric. Ultra Clorox® Regular Bleach is one of the leading household products used for the purpose of cleaning white cotton panties of menstrual fluid stain. Ultra Clorox® Regular Bleach is a designated trademark of the Clorox Company. A typical, undiluted Ultra Clorox Regular Bleach solution contains 6-7.35 wt % of sodium hypochlorite and less than 0.2 wt % of sodium hydroxide. The pH of the undiluted Clorox Bleach solution is around 11.4. Like other chlorine-releasing bleaches, Clorox Bleach, even diluted, will disintegrate the fabric. Moreover, even after lengthy soaking, a dark residue stain may still remain on the cotton fabric, even with scrubbing. Vigorous scrubbing accelerates deterioration of the bleach-weakened cotton fibers which, again, leads to damaged panties, and expense and frustration. Some household products, such as hydrogen peroxide, produce free oxygen to dislodge menstrual fluid discharge from cotton fabric but this process may be effective only when the discharge is fresh and minimal fluid penetration of the fabric has occurred.

Perspiration stain in the underarm areas of white cotton fabric shirts and blouses is also difficult to remove, even for professionals in the garment laundry and cleaner business. Often the stain is not completely removed.

There is a clamor among women around the world for a process that they can use to remove fresh, set-in or old menstrual fluid or perspiration stain from white cotton fabric, and that can do so easily, rapidly, with little or no scrubbing, and with no damage to the cotton fabric.

SUMMARY OF THE INVENTION

One object of the present invention is to provide methods for reducing the damaging effect of hypochlorite-containing solutions on soft fabrics. The fabrics can be made of cotton, cotton/polyester, or other materials. The fabrics may be, for example, in white.

In accordance with one aspect of the present invention, the method comprises the steps of (a) modifying a hypochlorite-containing solution by adding an alkali metal hydroxide to the solution, such that the weight concentration ratio of the alkali metal hydroxide over the hypochlorite-salt in the modified solution is no less than 1:12.5; and (b) contacting the modified solution with a stain on a soft fabric article for at least one minute to remove the stain. In certain cases, the contact with the stain can last for at least 5, 10, 15, 30, 60 minutes or longer before the stain is cleaned.

The stain can be any type of hard-to-remove stains, such as fresh, set-in or old menstrual fluid or underarm perspiration stains, Other examples of hard-to-remove stains include, but are not limited to, those caused by wine, grass, urine, feces, and certain types of ink.

In a preferred embodiment, the alkali metal hydroxide is sodium hydroxide, and the hypochlorite salt is sodium hypochlorite. The weight concentration ratio of sodium hydroxide over sodium hypochlorite in the modified solution can be no less than 1:10, 1:5, 1:2 or 1:1. A higher sodium hydroxide/sodium hypochlorite ratio can also be used.

In one embodiment, the modified solution includes at least 0.2, 0.3, 0.5, 1, 2, 3 or higher weight percent of sodium hydroxide. For instance, the weight percentage of sodium hydroxide can range from about 0.5% to about 3%.

In another embodiment, the modified solution includes about 2.5 weight percent of sodium hypochlorite and 0.5 to 1.25 weight percent of sodium hydroxide. In yet another embodiment, the modified solution includes about 6 weight percent of sodium hypochlorite and 1.2 to 3 weight percent of sodium hydroxide.

In accordance with another aspect of the present invention, the method for reducing the damaging effect of a hypochlorite salt-containing solution comprises the steps of (a) modifying the solution by adding an alkali metal hydroxide to the solution, such that the pH of the modified solution is at least 11.8, and (b) contacting the modified solution with a stain on a soft fabric article for at least one minute to remove the stain. The fabric article may be, for example, in white.

The pH of the modified solution can be at least 12, 12.5 or 13. In one embodiment, the pH of the modified solution is about 13.

In a preferred embodiment, the alkali metal hydroxide is sodium hydroxide, and the hypochlorite salt is sodium hypochlorite. The weight percentage of sodium hypochlorite in the modified solution can be at least 0.1%, 0.5%, 1%, 2%, 3%, 4%, 5%, 6% or more.

In one embodiment, the modified solution is a modified form of Ultra Clorox Bleach Regular, Ultra Clorox Bleach Regular typically contains about 6 weight percent of sodium hypochlorite and less than 0.2 weight percent of sodium hydroxide. To make the modified form, an additional amount of sodium hydroxide is added.

Another object of the present invention is to provide, methods and kits useful for removing hard-to-remove stains from soft fabric articles. The soft fabric articles can be, for example, panties, shirts, blouses, pants, jeans, trousers or other soft fabric articles. The removal preferably is accomplished with little or no scrubbing of the fabrics.

In accordance with one aspect of the present invention, the method includes the steps of (a) providing a cleaning composition which contains an effective amount of a metallic salt of hypochlorous acid and at least 0.2 weight percent of an alkali metal hydroxide, and (b) contacting the cleaning composition with a stain on a soft fabric article for at least one minute.

In one embodiment, the metallic salt of hypochlorous acid is sodium hypochlorite, and the alkali metal hydroxide is sodium hydroxide. The cleaning composition can include, for example, at least 0.3 weight percent of sodium hydroxide. Preferably, the cleaning composition contains about 0.5 to about 3 weight percent of sodium hydroxide. In one embodiment, the weight concentration ratio of sodium hypochlorite over sodium hydroxide is preferably about 2:1.

The stain to be removed can be menstrual fluid or underarm perspiration stain. The contact between the cleaning composition and the stain can last at least five, fifteen, thirty minutes, or longer, with no damage to the soft fabric article.

In accordance with another aspect of the present invention, the method includes the steps of (a) providing a cleaning composition which contains an effective amount of a metallic salt of hypochlorous acid and has a pH of at least 11.8, and (b) contacting the cleaning composition with a stain on a soft fabric article for at least one minute. The metallic salt of hypochlorous acid preferably is sodium hypochlorite.

In one embodiment, the cleaning composition contains at least 0.3 weight percent of sodium hydroxide. In another embodiment, the cleaning composition contains about 0.5 to about 3 weight percent of sodium hydroxide.

The pH of the cleaning composition can be, for example, at least 12, 12.5, or 13. The cleaning composition can contact with the stain on the soft fabric article for at least five, fifteen, thirty minutes, or longer, with no damage to the fabric article.

In accordance with yet another aspect of the present invention, a kit is provided that is useful for removing stains from clothes or other soft fabrics. The kit includes a cleaning composition which contains an effective amount of a metallic salt of hypochlorous acid and at least 0.2 weight percent of an alkali metal hydroxide. The kit also has an instruction indicating that the cleaning composition contained therein can be used for removing stains from soft fabric articles.

The metallic salt of hypochlorous acid preferably is sodium hypochlorite, and the alkali metal hydroxide preferably is sodium hydroxide. In one embodiment, the cleaning composition comprises about 0.5 to about 3 weight percent of sodium hydroxide. In one embodiment, the weight concentration ratio of sodium hypochlorite over sodium hydroxide is about 2:1. In another embodiment, the kit includes a spray bottle capable of spraying the cleaning composition onto the soft fabric article.

In accordance with yet another aspect of the present invention, the kit includes (a) a cleaning composition which contains an effective amount of a metallic salt of hypochlorous acid and which has a pH of at least 11.8; and (b) an instruction for removing stains from soft fabric articles employing the cleaning composition. The metallic salt of hypochlorous acid preferably is sodium hypochlorite. In one embodiment, the cleaning composition includes 0.5-3 weight percent of sodium hydroxide.

In accordance with a further aspect of the present invention, the kit contains (a) a first compartment which includes a sodium hypochlorite solution which preferably has a pH of between 11 and 13; and (b) a second compartment which includes a sodium hydroxide solution; and (c) an instruction for removing the stain from the soft fabric article employing the kit.

Other features, objects, and advantages of the present invention are apparent in the detailed description that follows. It should be understood, however, that the detailed description, while indicating preferred embodiments of the present invention, is given by way of illustration only, not limitation. Various changes and modifications within the scope of the invention will become apparent to those skilled in the art from the detailed description.

DETAILED DESCRIPTION OF THE INVENTION

The present invention is based on the surprising discovery that a cleaning composition which contains a metallic salt of hypochlorous acid and an appropriate amount of alkali metal hydroxide is effective for removing hard-to-remove stains from clothes and other soft fabric articles. The metallic salt of hypochlorous acid preferably is sodium hypochlorite. The alkali metal hydroxide preferably is sodium hydroxide. Other hypochlorous salts and/or alkali metal hydroxides can also be used in the present invention.

Sodium hypochlorite (NaOCl) dissolves in water to sodium and hypochlorite ions. The hypochlorite ion is a strong oxidant which can react with numerous materials. The stability of the sodium hypochlorite solution is affected by the pH of the solution. It has been reported that sodium hypochlorite is the most stable when the pH of the solution is between 11 to 13. Such a high pH can be created by adding excess alkali metal hydroxide, such as sodium hydroxide, to the sodium hypochlorite solution.

The decomposition rate of the hypochlorite ion increases when the pH of the solution falls below 11. This is because of the rapid acid catalyzed decomposition pathway of the hypochlorite ion. The rate of decomposition also increases when the pH of the solution is over 13. This is due to the increase in the ionic strength of the solution caused by the increased level of excess alkali metal hydroxide added to the solution. The present invention finds that even with a high ionic strength, the sodium hypochlorite/sodium hydroxide solution is still effective for removing menstrual fluid, underarm perspiration and other hard-to-remove stains from soft fabric articles. In addition, the addition of appropriate amounts of alkali metal hydroxide to a hypochlorite solution retards the damaging effect of the hypochlorite solution on soft fabric (such as cotton fabric).

The concentration of sodium hypochlorite in the cleaning composition of the present invention preferably is at least 0.1% by weight, based on the total weight of the cleaning composition. For instance, the concentration of sodium hypochlorite can be at least 0.5, 1, 2, 3, 4, 5, 6, 7 or 8% by weight. In one embodiment, the concentration of sodium hypochlorite ranges from 0.1 to 10% by weight. In another embodiment, the concentration of sodium hypochlorite is about 0.5 to 5% by weight. In yet another embodiment, the concentration of sodium hypochlorite is about 1 to 2.5% by weight. In still another embodiment, the concentration of sodium hypochlorite is about 1.5 to 2% by weight.

The concentration of sodium hydroxide in the cleaning composition preferably is at least 0.2% by weight, based on the total weight of the cleaning composition. For instance, the concentration of sodium hydroxide can be at least about 0.3, 0.4, 0.5, 1, 1.5, 2, 2.5, 3, 4 or 5% by weight. In one embodiment, the concentration of sodium hydroxide ranges from about 0.5 to about 3% by weight. In another embodiment, the concentration of sodium hydroxide ranges from about 1 to 2% by weight. It is generally known that an appropriate amount of alkali metal hydroxide (such as sodium hydroxide) increases the stability of sodium hypochlorite in the cleaning composition. Without limiting the present invention to any particular mechanism, Applicant has found that alkali metal hydroxide (such as sodium hydroxide) adds significantly to the cleaning power of sodium hypochlorite to remove stains, such as menstrual fluid or underarm perspiration stains, from clothes and other soft fabric articles while significantly increasing the compatibility of sodium hypochlorite with soft fabric, such as cotton fabric, thereby preventing sodium hypochlorite from damaging the fabric.

The weight concentration ratio of sodium hydroxide over sodium hypochlorite may vary substantially without affecting the stain-removing power of the cleaning composition. Preferably, the weight concentration ratio of sodium hydroxide over sodium hypochlorite is no less than 1:12.5. For instance, the weight concentration ratio of sodium hydroxide over sodium hypochlorite can be no less than 1:10, 1:5, 1:2.5 or 1:1. In one embodiment, the weight concentration ratio of sodium hydroxide over sodium hypochlorite can range from about 1:5 to about 5:1. In another embodiment, the weight concentration ratio of sodium hydroxide over sodium hypochlorite is about 1:3 to about 1:1. For instance, the weight concentration ratio of sodium hydroxide over sodium hypochlorite can be about 1:2.

In one embodiment, the cleaning composition includes about 6 weight percent of sodium hypochlorite and 1.2 to 3 weight percent of sodium hydroxide. In another embodiment, the cleaning composition includes about 2.5 weight percent of sodium hypochlorite and 0.5 to 1.25 weight percent of sodium hydroxide. The cleaning composition of the present invention can be a modified form of regular Clorox Bleach or Ultra Clorox Bleach with additional sodium hydroxide.

The pH of the cleaning composition preferably is at least about 11.8. For instance, the pH of the cleaning composition can be at least 12, 12.5 or 13. In one embodiment, the pH of the cleaning composition is about 13.

Other ingredients or addictives can be added in the cleaning composition. These ingredients or addictives include, for example, chelating agents, phosphorous-containing salts, surfactants, or abrasive agents. These ingredients or addictives, however, are not necessary for the stain-removing function of the cleaning composition. In one embodiment, the cleaning composition is free of chelating agents, phosphorous-containing salts, surfactants, and abrasive agents.

In one embodiment, Tilex Instant Mildew Stain Remover®, Scrub Free Mildew Stain Remover® or other off-the-shelf hard-surface cleaners, all of which are marketed and targeted exclusively as such, are used for removing menstrual fluid, underarm perspiration and other hard-to-remove stains from soft fabrics. Tilex Instant Mildew Stain Remover and Scrub Free Mildew Stain Remover are designated trademarks of the Clorox Company and Church & Dwight Company, Inc., respectively. The product labels and/or use instructions clearly and distinctively warn against using these commercial cleaners on clothes or soft fabrics, leading the users away from such usages, believing the compositions are too caustic for clothes or other soft fabrics. Tilex Instant Mildew Stain Remover contains about 1-5 wt % sodium hypochlorite and about 0.5-2 wt % sodium hydroxide. The pH of Tilex Instant Mildew Stain Remover is about 12.4-12.8. Scrub Free Mildew Stain Remover contains about 2.3% sodium hypochlorite and less than 1% sodium hydroxide. The pH of Scrub Free Mildew Stain Remover is about 11.8-12.2. Other commercial available cleaners that can be used in the present invention include, but are not limited to, Scrubbing Bubbles Mildew Stain Remover® and Lysol Mildew Remover®, Scrubbing Bubbles Mildew Stain Remover and Lysol Mildew Remover are designated trademarks of SC Johnson and Reckitt Benckiser Inc., respectively.

The cleaning composition of the present invention can be stored in a container, such as a spray bottle, prior to use. Preferably, the container has an instruction indicating that the enclosed cleaning composition can be used for removing stains, such as menstrual fluid or perspiration stains, from soft fabric articles.

Sodium hypochlorite and sodium hydroxide can be separately stored prior to use. For instance, they can be stored in two separate compartments of a container. The first compartment encloses a sodium hypochlorite solution which preferably has a pH of between 11 and 13. The second compartment encloses a concentrated sodium hydroxide solution. The two solutions are mixed together upon use. An exemplary device suitable for this purpose is illustrated in U.S. Pat. No 6,398,077, which is incorporated herein by reference.

Soft fabric articles suitable for the present invention can be made of a variety of materials, such as cotton or cotton/polyester. The fabric articles preferably are in white color. Examples of soft fabric articles suitable for the present invention include, but are not limited to, panties, shirts, blouses, pants, jeans, trousers, and other wear and bed products.

The stains to be removed can be menstrual fluid stains or underarm perspiration stains. Other hard-to-remove stains, such as wine, grass, urine, feces, or ink stains, can also be removed using the present invention. The contact between the cleaning solution and the stain may last for at least one minute before the stain is removed. In one embodiment, the contact between the cleaning solution and the stain lasts for at least 5, 10, 15, 30, 60 or more minutes before the stain is removed.

In accordance with one aspect of the present invention, the soft fabric article that is to be destained is first soaked in cold water until the stain areas are thoroughly saturated with water. The fabric article can be swirled around in the water to dislodge as much stain as possible. For articles heavily soiled with stains, the water may be changed to repeat the soaking and swirling step.

The fabric article is then squeezed to remove excess water. White cotton articles heavily stained with menstrual fluid may be tinted slightly pink after this step. The stained areas are arranged for maximal exposure in preparation for the spray with the cleaning composition. Suitable cleaning compositions used in the present invention include commercial hard-surface cleaners such as Scrubbing Bubbles Mildew Stain Remover®, Tilex Mildew Remover®, Lysol Mildew Remover® and Scrub Free Mildew Stain Remover®.

The cleaning composition can be sprayed on the stain areas, or the entire article if necessary. After spraying, the stain areas can be compressed and confined into a small container to saturate and soak the stain areas or the entire article in the cleaner. In one instance, two pairs of panties can fit entirely into a pint-sized plastic container.

The stained areas are soaked with the cleaning composition until the stain has been removed. This may require about one to five minutes for removing fresh menstrual fluid stain, and about thirty minutes to two hours for removing old underarm perspiration stain. The fabric article can be subsequently inspected for any remaining stain. If necessary, spot spray can be applied again to remove the remaining stain.

After all stain has been removed, the fabric article is thoroughly rinsed in cold water before being put through the detergent wash/rinse and dry cycle, particularly if the fabric article is combined with non-colorfast clothing in the wash. Also, this assures that all sodium hydroxide has been removed from the fabric article before it is worn next to the skin. According to the present invention, menstrual fluid stains or underarm perspiration stains may be removed from a soft fabric article with little or no scrubbing of the article.

For in-place removal of small menstrual fluid stain spots from white sheets, an absorbent white toweling may be located underneath the spots. A small amount of spray is applied and confined to the spotted areas. After stain is gone, the treated areas may be dampened with a wet cloth to remove the spray product and then allowed to dry.

The treated fabric article preferably is not combined with non-colorfast clothing without first rinsing the treated article thoroughly in cold water. After the stain is removed, the fabric article preferably is not soaked with the cleaning composition any longer than necessary.

It should be understood that the above-described embodiments and the following examples are given by way of illustration, not limitation. Various changes and modifications within the scope of the present invention will become apparent to those skilled in the art from the present description.

Example I

Comparison of Scrubbing Bubbles Mildew Stain Remover®, Tilex Mildew Remover®, Lysol Mildew Remover® and Scrub Free Mildew Stain Remover® to Clorox® Bleach for the Removal of Menstrual Fluid Stains and Underarm Perspiration Stains Tests reported below show that white cotton fibers have a greater tolerance for Scrubbing Bubbles Mildew Stain Remover®, Tilex Mildew Remover® and Lysol Mildew Remover® than for bleaching products like Clorox® Bleach. In addition, the spray application and rapid removal of menstrual fluid stain and underarm perspiration stain associated with Scrubbing Bubbles Mildew Stain Remover®, Tilex Mildew Remover®, Lysol Mildew Remover® and Scrub Free Mildew Stain Remover®, versus the long immersed soaking process typical of products currently being used for the same purpose, indicate that the mildew removers can be used with greater safety on white cotton fabric.

Observed was the experimental testing of five common household products; (a) dilute Clorox® Bleach (sodium hypochlorite, 2.4%), (b) Tilex Mildew Remover® (sodium hypochlorite, 2.4%), (c) Lysol Mildew Remover® (sodium hypochlorite, 2.0%), (d) Scrubbing Bubbles Mildew Stain Remover®, and (e) Scrub Free Mildew Stain Remover® for the removal of fresh menstrual fluid stain from white cotton (100%) panties. Each of the four mildew remover products was liberally sprayed on a designated one of four panty articles, resulting in excellent removal of the stains from each panty article in less than 1 minute. A pair of similarly soiled panties was soaked in-Clorox® Bleach for an hour but the test was terminated, with stain still remaining, because of concern for Clorox® Bleach damage to the panties. The remaining stain was quickly and successfully treated with one of the mildew remover products.

Two additional white cotton panties with set-in menstrual fluid stain were treated with the product known as Shout® (label instructs the user to soak clothing with set-in stains in Shout overnight or longer) but Shout failed to remove the stains which, subsequently, resisted several wash and dry cycles. Shout® is a designated trademark of S. C. Johnson. These set-in residue stains were sprayed with Tilex Mildew Remover®. For the first pair panties, a single spray application of Tilex Mildew Remover® completely removed the set-in residue stain in 7 minutes. For the second pair of panties, four spray applications (a total of 15 squirts) and 30 minutes were required for 95%-99% removal of the set-in residue stain. At least a dozen successful tests followed, using the mildew removers on white cotton panties stained with menstrual fluid.

Experimental observations of Clorox Bleach, Scrubbing Bubbles Mildew Stain Remover, Tilex Mildew Remover, Lysol Mildew Remover, and Scrub Free Mildew Stain Remover were conducted to study the extent of physical damage to cotton cloth that may be caused by these products. An approximate 10 $cm^2$ patch of white 100% cotton cloth (panty crotch thickness) was immersed in 10 ml of the Clorox product. Likewise, similar patches were immersed in 10 ml each of the mildew removal products. Within four hours, the patch soaked in Clorox was shredded. After 5 to 6 hours, the patch soaked in Scrub Free Mildew Stain Remover® began to shred. After eight hours, the patches soaked in the remaining three mildew removal products were taken out of their solutions, dried, stretched and found to be intact.

Tests were conducted to determine the effectiveness of Scrubbing Bubbles Mildew Stain Remover, Tilex Mildew Remover, Lysol Mildew Remover, and Scrub Free Mildew Stain Remover on perspiration stain, one of the most difficult stains to remove from the underarms of shirts and blouses. A white shirt, 65% polyester and—35% cotton, was the test material. A years-old yellowish-brown perspiration stain was embedded in the seams and fabric of the underarm areas of the sleeves, having stubbornly resisted many wash and dry cycles. The stained areas of the sleeves were immersed in cold water for 30 minutes. Then the stained areas were sprayed liberally with Tilex Mildew Remover® and stuffed into a pint-sized plastic container, and allowed to stand for 1 hour. A barely visible yellowish-brown coloration on portions of the seams still remained but this disappeared completely after a brief scrubbing between the hands in the spray product that was left in the fabric. Then the shirt was put through a normal wash and dry cycle. Six undershirts with old, heavily baked-in underarm perspiration stains, assumed impossible to remove, were successfully processed: one by Scrubbing Bubbles Mildew Stain Remover three by Tilex Mildew Remover, one by Lysol Mildew Remover, and one by Scrub Free Mildew Stain Remover. Scrubbing Bubbles Mildew Stain Remover required 40 minutes to remove completely a stubborn, reddish-brown stain. Tilex Mildew Remover required 30 minutes to remove moderate stains from each of two undershirts. The third undershirt had a heavy, reddish-brown stain which was much more stubborn, similar to that treated by Scrubbing Bubbles Mildew Stain Remover®, requiring approximately 75 minutes for complete removal. Lysol Mildew Remover required 30 minutes and Scrub Free Mildew Stain Remover required 20 minutes, respectively, for the removal of moderate stains.

In another experiment, the underarm areas of a 65% polyester and 35% cotton shirt with underarm stains were soaked in a Scrubbing Bubbles Mildew Stain Remover® spray for the arbitrary period of one hour. The stain was removed with no adverse effects to the garment.

Typical of chlorine-releasing products, such as Tilex Mildew Remover®, Lysol Mildew Remover®, Scrubbing Bubbles Mildew Stain Remover® and Scrub Free Mildew Stain Remover®, are not safe for use with non-colorfast dyes or with silk cloth. A test was conducted to study the extent of physical damage to a pair of pure silk male under briefs soaked in Tilex Mildew Remover®. At 3½ hours the briefs were damaged to shreds.

Example II

Comparison of Clorox® Bleach to a Cleaning Composition Comprising 2.4 wt % Sodium Hypochlorite and 1.25% Sodium Hydroxide Two similar patches (approximately 2.5×2.5 $cm^2$) of 100% cotton fabric were cut from the crotch of a new panty. The first patch was immersed in a diluted Clorox® Bleach solution. The diluted Clorox® Bleach solution contained about 2.4 wt % sodium hypochlorite. After six hours of soaking, the first patch showed signs of shredding. After ten hours of soaking, the first patch shredded completely. In comparison, the second patch was immersed in a solution which contains about 2.4 wt % sodium hypochlorite and 1.25 wt % sodium hydroxide. After ten hours of soaking, no effect of shredding was observed.

A test similar to those described in EXAMPLE I was conducted for the solution that contains 2.4 wt % sodium hypochlorite and 1.25 wt % sodium hydroxide. The solution was placed in an opaque spray container and used in exactly the same manner for cleaning panties of menstrual fluid stain as the commercial mildew removers were used in EXAMPLE I. The solution had essentially the same results and effectiveness in removing menstrual fluid stains, as compared to the commercial mildew removers used in EXAMPLE I.

Example III

The Damage Effects of Hypochlorite Solutions to Cotton Patches and the Reduction Thereof Cotton patches which were resistant to hand-tearing were soaked in different bleach solutions until damages have begun to occur as evidenced by weakening of the fabric such that it can be torn by hands with moderate forces. For each bleach solution to be tested, multiple cotton patches were used. Each patch was inserted into a vial containing the bleaching solution. The patch was removed periodically from the vial to determine the extent of damage by manually administering a tearing action. $T_C$ (D) was the cumulative time of soaking before the patch became hand-tearable.

The bleach solutions were modified from Ultra Clorox® Bleach which contains about 6% NaOCl and less than 0.2% NaOH. Additional NaOH in dry form was added to Ultra Clorox® Bleach to increase the concentration of NaOH. As Table 1 shows, Ultra Clorox® Bleach damages cotton fabrics in an accumulated time of approximately one hour. Decreasing the ratio of NaOCl/NaOH progressively increases the accumulated times for which the bleach solution is cotton-safe. This Example indicates that NaOH, added to Ultra Clorox® Bleach, can abate the damage of cotton fabrics, thereby rendering the bleach solution cotton-safe.

TABLE 1

Comparison of the Damage Effects of Bleaching Solutions

| Cleaning Solution | NaOH (weight percentage) | NaOCl/NaOH (weight percentage ratio) | Tc(D) (hours) |
|---|---|---|---|
| Ultra Clorox Beach | 0-0.2 | over 30:1 | 1 |
| Solution #1 | 0.4-0.6 | 12:1 | 4 |
| Solution #2 | 1.0-1.2 | 5.5:1 | 6 |
| Solution #3 | 2.0-2.2 | 3:1 | 6 |
| Solution #4 | 3.0-3.2 | 2:1 | 9.5 |
| Solution #5 | 4.0-4.2 | 1.5:2 | 9.5 |
| Solution #6 | 6.0-6.2 | 1:1 | 9.5 |

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

What is claimed is:

1. A method for reducing at least one damaging effect of a hypochlorite salt-containing solution on a soft fabric article, the method comprising:

(a) forming a hypochlorite salt-containing solution having 0.5 to 2.4 weight percent of a hypochlorite salt;

(b) adding 0.2 to about 1 weight percent of an alkali metal hydroxide to the hypochlorite salt-containing solution, the amount of alkali metal hydroxide added being selected to produce a resulting solution with: (1) a pH of at least 11.8, and (2) a weight concentration ratio (CR) of alkali metal hydroxide to hypochlorite salt of 1:5 to 1:1; and (c) selecting the CR to provide to the resulting solution a quality of fabric safety that allows the resulting solution in its neat form to be in direct contact with the soft fabric article for at least one minute without damage to the soft fabric article.

2. The method of claim 1, wherein the solution comprises about 1 weight percent to 2.4 weight percent of a hypochlorite salt.

3. The method of claim 1, wherein the weight concentration ratio of alkali metal hydroxide to hypochlorite salt is about 1:3 to about 1:1.

4. The method of claim 1, wherein the hypochlorite salt is sodium hypochlorite.

5. The method of claim 1, wherein the alkali metal hydroxide is sodium hydroxide.

6. A method for removing a stain from a soft fabric article with a hypochlorite salt-containing solution, the method comprising:

(a) forming a hypochlorite salt-containing solution having 0.5 to 2.4 weight percent of a hypochlorite salt;

(b) adding 0.2 to about 1 weight percent of an alkali metal hydroxide to the hypochlorite salt-containing solution, the amount of alkali metal hydroxide added being selected to produce a resulting solution with: (1) a pH of at least 11.8, and (2) a weight concentration ratio (CR) of alkali metal hydroxide to hypochlorite salt of 1:5 to 1:1;

(c) selecting the CR to provide to the resulting solution a quality of fabric safety that allows the resulting solution in its neat form to be in direct contact with the soft fabric article for at least one minute without damage to the soft fabric article; and (d) instructing a user of the solution to remove stains from the soft fabric article by directly contacting the article with the hypochlorite salt-containing solution for at least one minute.

7. The method of claim 6, wherein the solution comprises about 1 weight percent to 2.4 weight percent of a hypochlorite salt.

8. The method of claim 6, wherein the weight concentration ratio of alkali metal hydroxide to hypochlorite salt is about 1:3 to about 1:1.

9. The method of claim 6, wherein the hypochlorite salt is sodium hypochlorite.

10. The method of claim 6, wherein the alkali metal hydroxide is sodium hydroxide.

* * * * *